US006655613B1

(12) United States Patent
Brown

(10) Patent No.: US 6,655,613 B1
(45) Date of Patent: Dec. 2, 2003

(54) FIRE-FIGHTING WATER TURRET

(75) Inventor: Arthur E. Brown, Mission Viejo, CA (US)

(73) Assignee: Arthur Brown, Inc, Mission Viejo, CA (US)

( * ) Notice: Subject to any disclaimer, the term of this patent is extended or adjusted under 35 U.S.C. 154(b) by 96 days.

(21) Appl. No.: 09/882,003

(22) Filed: Jun. 15, 2001

Related U.S. Application Data

(60) Provisional application No. 60/213,016, filed on Jun. 21, 2000.

(51) Int. Cl.[7] ..... B05B 15/08

(52) U.S. Cl. ..... 239/587.1; 169/24

(58) Field of Search ..... 239/587.1–587.5; 169/24, 25; 141/387–389; 901/15, 16; 285/275, 355, 372, 418

(56) References Cited

U.S. PATENT DOCUMENTS 56,284 A * 7/1866 Smith et al. ..... 239/258
2,927,607 A * 3/1960 Bily ..... 137/615

* cited by examiner

*Primary Examiner*—Lisa A. Douglas
(74) *Attorney, Agent, or Firm*—Stout, Uxa, Buyan & Mullins, LLP; Donald E. Stout

(57) ABSTRACT

A fire-fighting turret or monitor includes a curved pipe formed in three successive sections separated by swivelable joints. The first joint swivels about the axis of the first section; the second joint swivels about an axis disposed at an acute angle to the first axis; and the third section includes a corresponding bend so that the exit from the third section can be pointed anywhere within substantially a hemisphere.

15 Claims, 7 Drawing Sheets

FIRE-FIGHTING WATER TURRET

FIELD OF THE INVENTION

This invention relates to a fire-fighting turret or monitor, or similar fluid-projecting device, which is mounted in a fixed position but can be aimed in any direction and at any elevational angle by rotating a pair of swivelable joints disposed at an acute angle to each other.

RELATED CASES

This application claims the benefit of provisional application Ser. No. 60/213,016 filed Jun. 21, 2000 and entitled "A New Design for Fire-fighting Water Turrets, or Monitors".

BACKGROUND OF THE INVENTION

In fire fighting and other applications, water turrets or monitors are used to direct a stream of water. Generally these monitors are controlled by a manual operator who maneuvers a handle or other mechanically linked device, or by an operator who remotely controls the action of the monitor through hydraulic or electric links or a combination thereof. Such monitors can also be operated and activated automatically, as for example by a fire detector or timed circuit.

It is desirable to make such turrets cover an area with a volume of water by appropriately moving the nozzle continuously or intermittently to aim the water stream in different directions. In general, the positional variables of the monitor include the elevation and azimuth in which the nozzle is pointing or spraying. Thus terms like Left, Right, Up and Down are used to label the positional turret controls and describe the motion of the stream.

As the state of the art has evolved from handheld hoses and nozzles to the manually operated turrets, and on to the remotely controlled and automatic monitors discussed above, there has been a tendency to add onto current methods without going back to the primary function to be served and creating a product from the ground up. Thus the axes necessary to create independent left-right and up-down actions were maintained without change from the hose to the monitor to the remote-controlled monitor. In addition, each of the axes or joints could be held against unintended movement by a mechanical device such as a friction lock or a pin in a hole. Automating merely meant adding electrical, mechanical or hydraulic actuators to the joints and swivels that were used in the mechanically controlled units. To gain the torque necessary to control the joints and to supply the static friction required to hold the nozzle in place when not being moved in one of the axes, a combination of gears including a worm gear was generally used.

Several general models of monitors have been devised to create the ability to sweep through the necessary range. One of these is a re-converging stream in which the water generally passes through a pipe that swivels to create the left-right rotation and coverage, then splits roughly equally and directs the water through separate symmetric pipes into flows which are perpendicular to the first swivel. This allows for a second set of swivels to provide the up-down coverage. Then the water is re-converged into a single stream and sent through a nozzle as desired. This model requires several complex cast components. Splitting the water into two pipes, forcing it through a quick series of sharp bends, then recombining the two streams which are running in almost opposite directions creates turbulence, back pressure and pressure losses that are detrimental to the water flow.

Another model can be thought of as a series of bent tubes. In this traditional configuration the water stream is forced over 45° of bends, with one bend being a 180° bend causing the stream to flow twice as far and twice as fast on the outside of the bend as the water on the inside of the bend. This geometry also creates turbulence and pressure drops that are adverse to the final stream pattern.

A third model is a tighter version of the bent tube design created by using castings. This allows for a tighter geometry but exaggerates the turbulence of flow speed differentials. In order to combat these problems, this design is forced to increase the cross-sectional area of the joint areas, which increases turbulence and forces acting on the joints. Even internal flow straightening vanes cast into the waterways to combat these deficiencies have the adverse effect of causing additional surface drag.

When these designs were automated to allow for operator control through switches or a joystick, or to allow for automatic operation in a preset manner without input from an operator, gearing and actuators such as electric and hydraulic motors were added on top of existing designs.

SUMMARY OF THE INVENTION

The present invention overcomes the problems of the prior art by providing a monitor or turret using a single curved tube with three mutually rotatable sections. The sections are separated by two swivelable joints whose axes are at an acute angle (e.g. 45°) to each other. The axes of the joints are interdependent, i.e. rotation of one joint changes the axial or angular orientation of the other joint. By concurrently rotating both joints, the nozzle can be aimed at any point within more or less a hemisphere centered on the monitor.

In accordance with one aspect of the invention, the joints are preferably rotated by a direct electric or hydraulic drive or servo motor in which the static position of the monitor is maintained electrodynamically or electromechanically. A microprocessor control computes and executes the appropriate motion of each joint to obtain a nozzle orientation having a desired bearing and azimuth within the monitor's hemisphere.

In the joint mechanism of this invention, the fundamental components of the joints and bearings are part of the waterway formed by the curved tube. The geometry of the joints is such that the water stream at each joint is always coaxial with that joint so as to eliminate any water-caused torque on the joint and drive. The geometry of the monitor is such that a full forwardly extending hemisphere ahead of a fire truck can be covered by a monitor mounted on a horizontal pipe on the front of the truck without requiring a 90° bend for vertical mounting. Alternatively, the inventive monitor can cover an entire upwardly extending hemisphere centered on the truck if mounted vertically.

DESCRIPTION OF THE PREFERRED EMBODIMENTS

Figure 1:
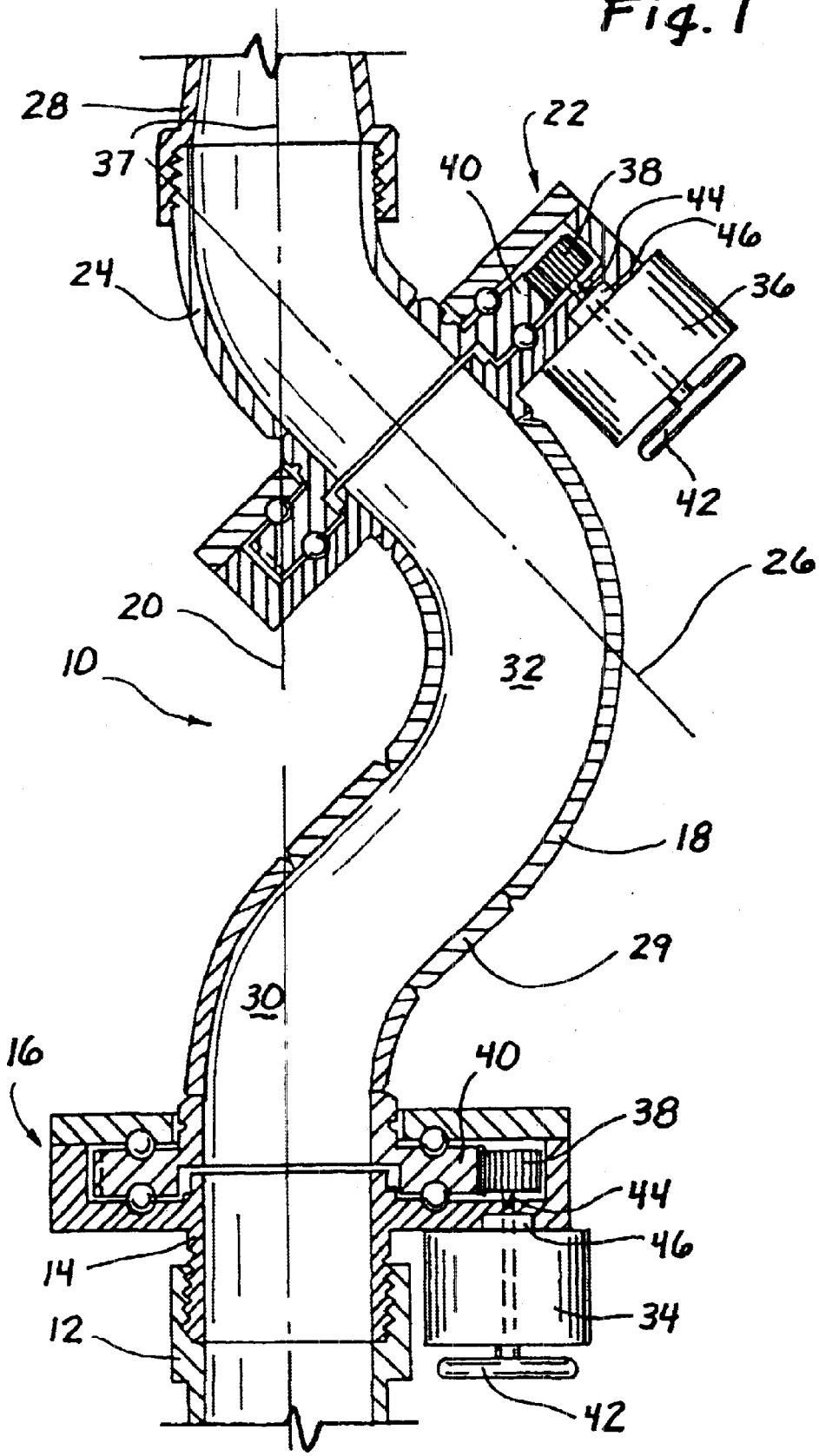
FIG. 1 is a horizontal section through a horizontally truck-mounted first embodiment of the monitor of this invention with the nozzle aimed straight ahead.

FIG. 1 shows a monitor 10 mounted on a horizontal pipe 12 e.g. on the front of a fire truck. The monitor 10 has a base section 14 terminating in a first joint 16 in which the midsection 18 of monitor 10 is mounted for swiveling movement about the horizontal axis 20. At its other end, the midsection 18 terminates in a second joint 22 in which the nozzle-carrying exit section 24 is mounted for swiveling movement about an axis 26 preferably disposed at a 45° angle to the axis 20. A 45° angle produces a hemispheric coverage; greater or lesser angles produce greater or lesser coverage. The midsection 18 and the exit section 24 are preferably so curved that when the nozzle 28 is aimed straight ahead as shown in FIG. 1, the base section 14 and the nozzle 28 are coaxial.

When the nozzle 28 is aimed straight ahead, the net torque exerted by the water stream on the monitor 10 as a whole is essentially zero because the torque created by the clockwise 45° bends in the exit section 24 and the proximal end 30 of the midsection 18 are balanced by the 90° counterclockwise bend of the distal portion 32 of midsection 18. It will be noted that at the joints 16, 22 themselves, the water flow is coaxial with the joint, so that regardless of the position of the joint, the water flow through the joint does not create any torque on it.

The joints 16 and 22 may be swiveled by motors 34 and 36, respectively. These motors have relatively small drive gears 38 that engage the much larger gear 40 of the swiveling joint itself. Because of this size disparity, it is possible in the device of the invention to use a direct drive instead of the more cumbersome worm gear drive typical of the prior art. This in turn makes it practical to swivel the joints 16, 22 by hand, e.g. in case of a motor failure, through a hand wheel 42.

To prevent undesired movement of the monitor 10, the shafts 44 of drive gears 38 may be equipped with conventional brakes 46 that prevent the shafts 44 from turning unless the motors 34, 36 are powered or the brake 46 is manually released. Alternatively, the motors 34, 36 may be computer-controlled servomotors that electrically maintain the joints 16, 22 in the desired positions. Dynamic braking may also be achieved by shorting the motor poles through a normally closed switch that can be opened for manual override.

Figure 2:
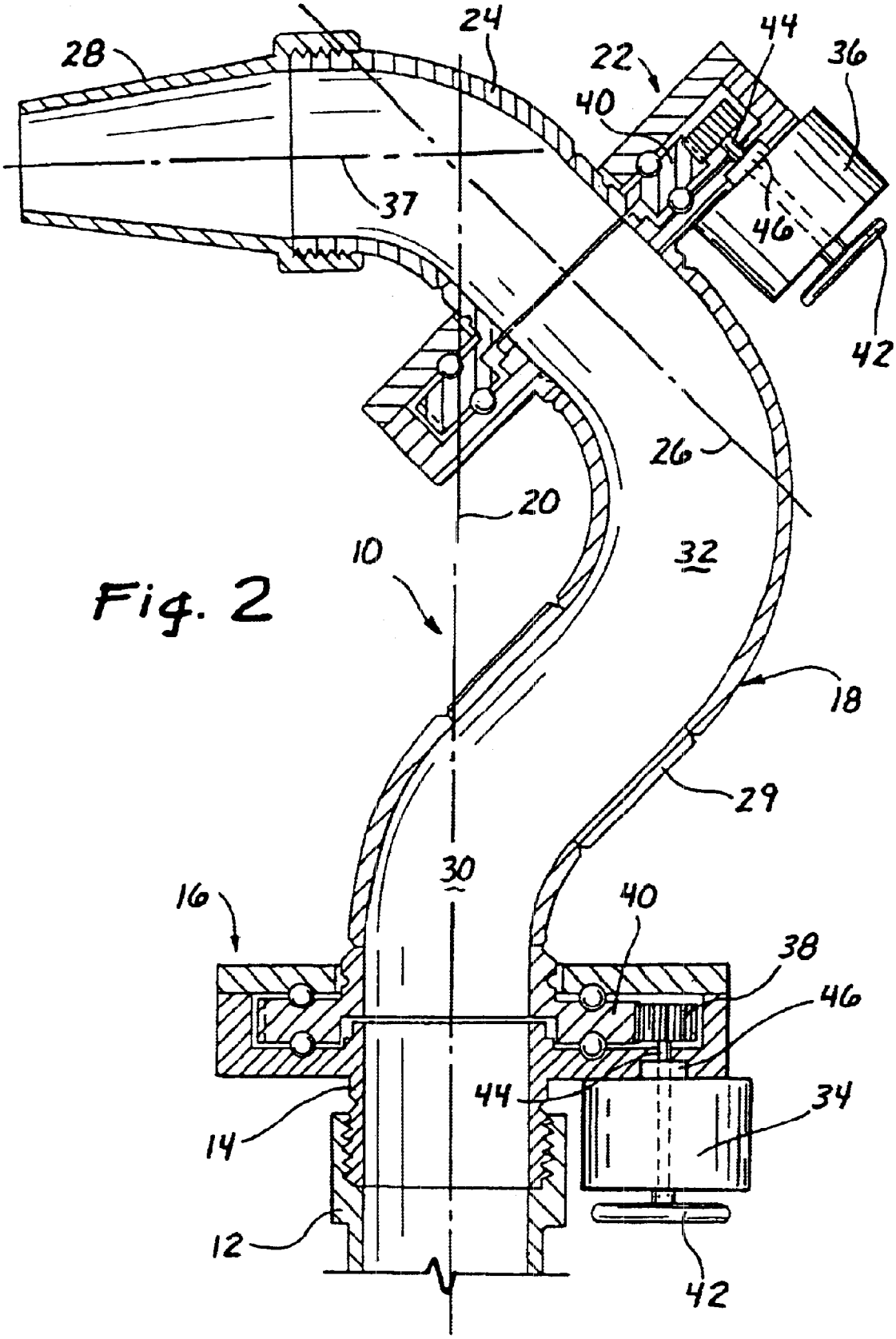
FIG. 2 is a view similar to FIG. 1 but showing the nozzle aimed to the left.
Figure 3:
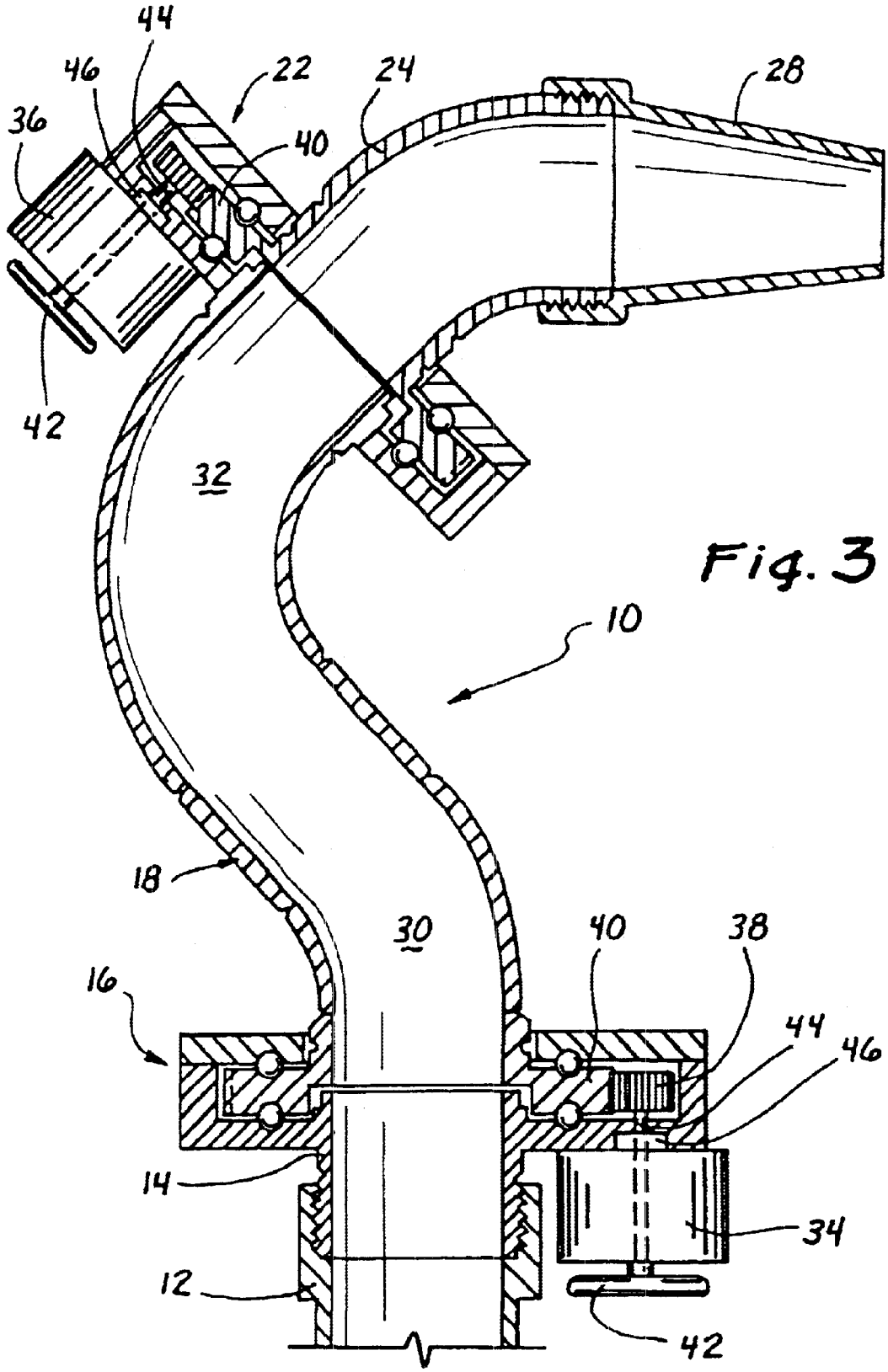
FIG. 3 is a view similar to FIG. 1 but showing the nozzle aimed to the right.
Figure 4:
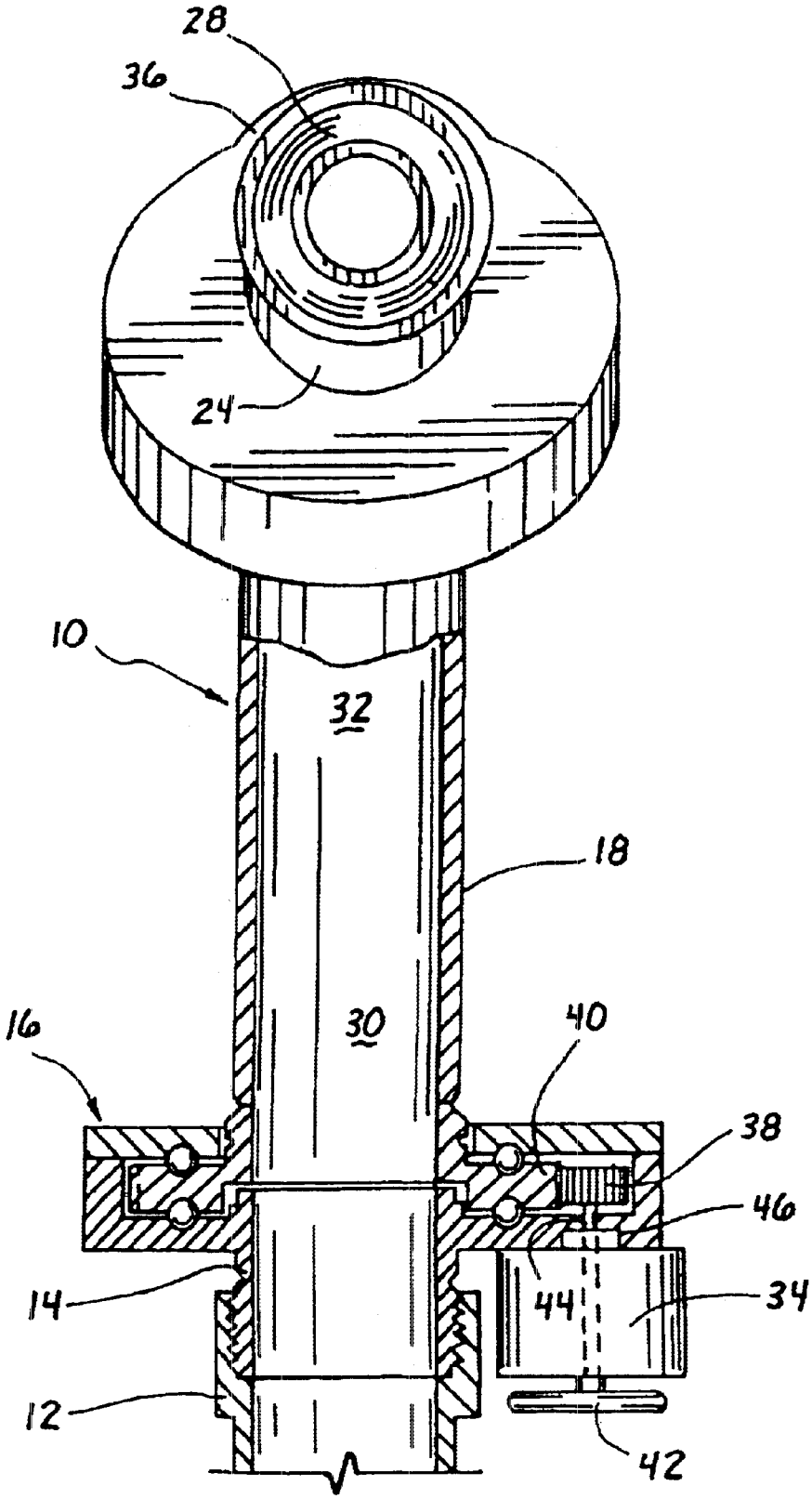
FIG. 4 is a plan view of the monitor with the nozzle aimed up.

FIGS. 2 through 4 show the nozzle 28 aimed to the left, to the right, and to the observer, respectively. If the two limit positions of the axis 37 of nozzle 28 (which is at an acute angle to axis 26) as a result of the swiveling of joint 22 are coaxiality with axis 20 and perpendicularity thereto, FIGS. 2–4 will show that the monitor of FIG. 1 is capable of aiming the nozzle 28 anywhere within a hemisphere centered on the monitor 10.

Figure 5:
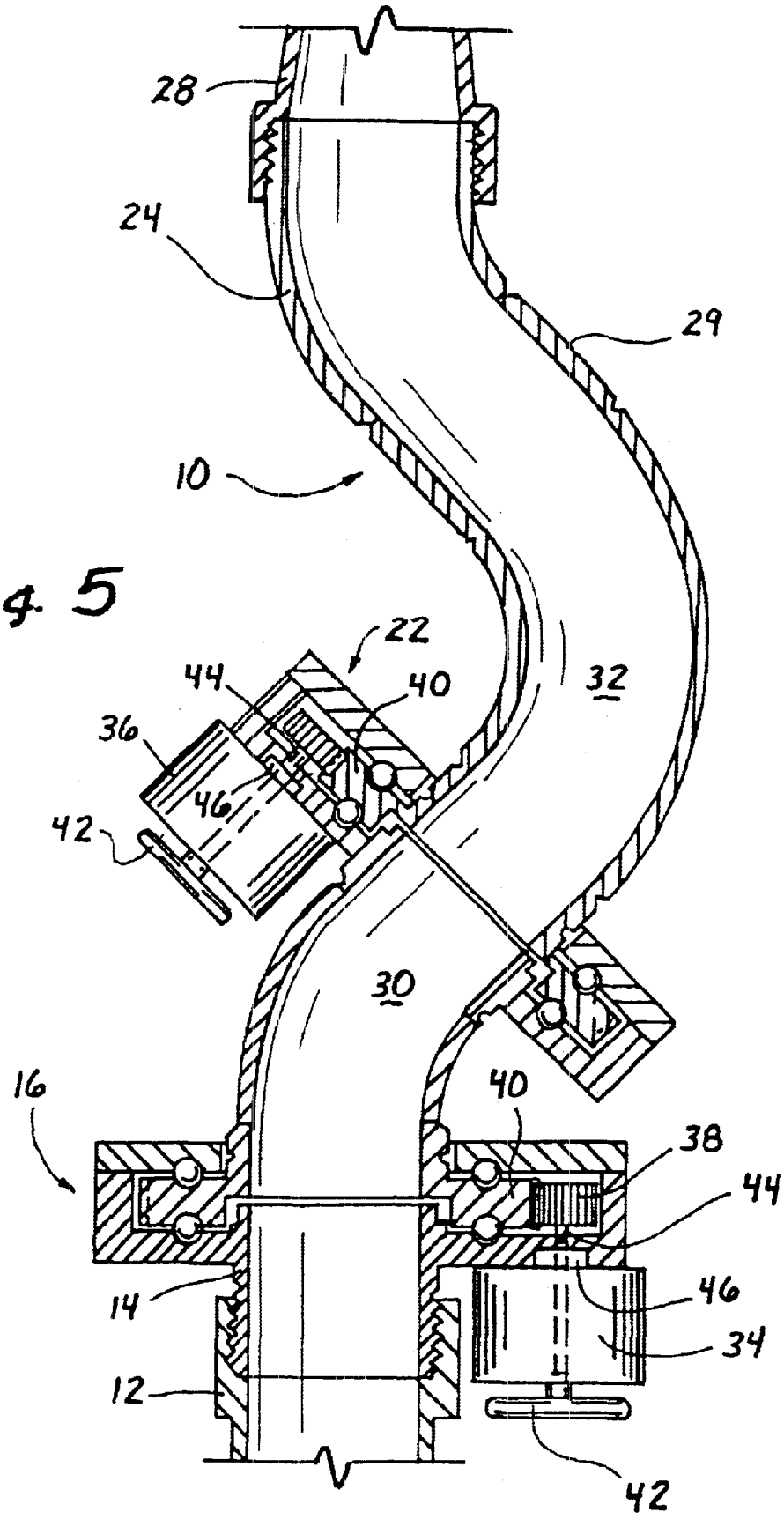
FIG. 5 is a view similar to FIG. 1 but showing an alternative embodiment of the invention.
Figure 6:
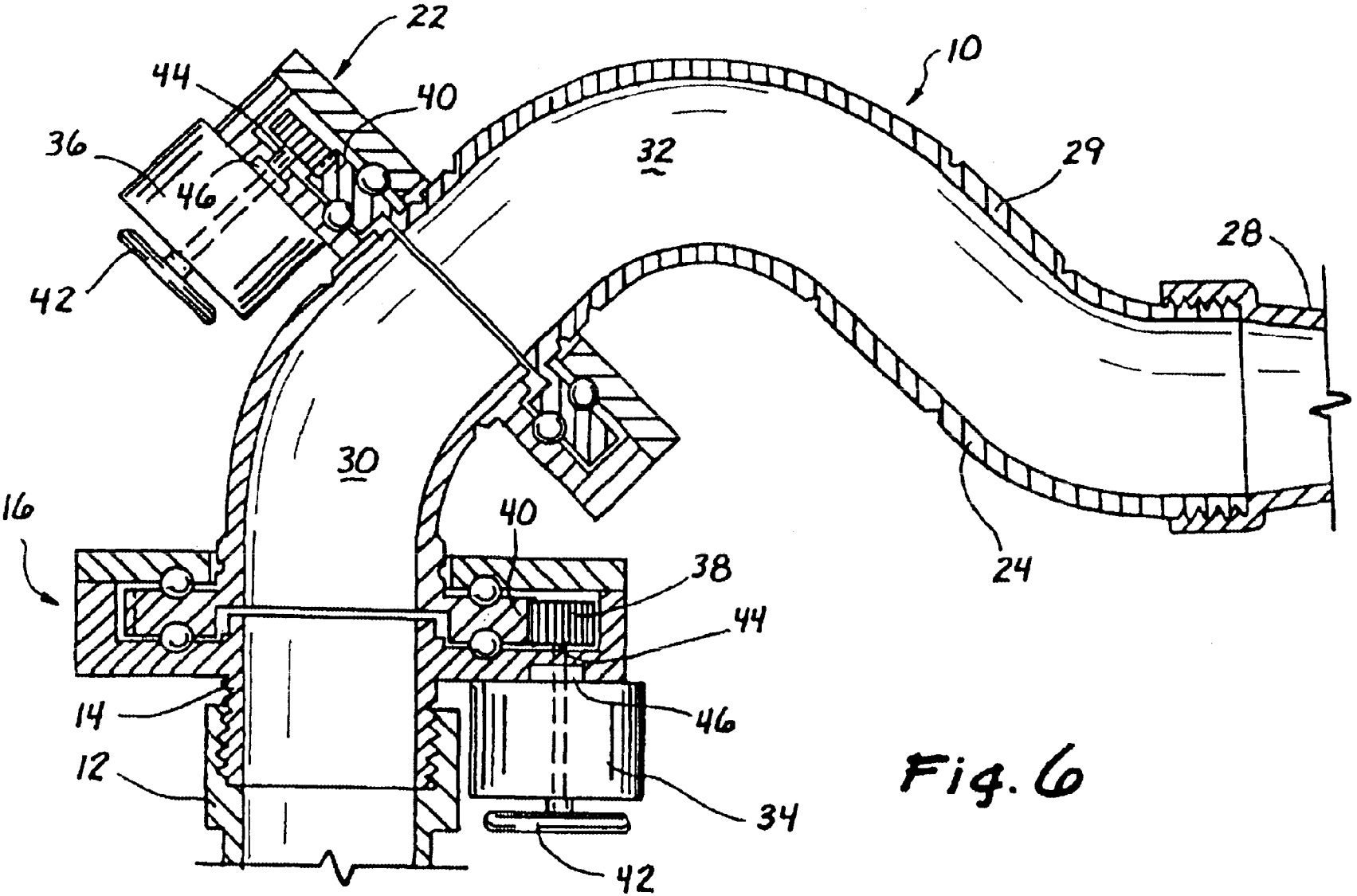
FIG. 6 is a view similar to FIG. 3 but showing the alternative embodiment of FIG. 5.

FIGS. 5 and 6 illustrate an alternative embodiment of the invention, in which the midsection 18 forms a single 45° bend between the joint 16 and the joint 22, with the exit section 24 having the clockwise (in FIG. 5) 90° bend followed by a counterclockwise (in FIG. 5) 45° bend to the nozzle 28. Otherwise, however, the embodiment of FIGS. 5 and 6 works in the same way as the embodiment of FIGS. 1–4. It is, however, preferable from a torque point of view because the nozzle 28 in this embodiment is nearer to the joint 16 in the direction of the axis 20 than in the embodiment of FIGS. 1–4.

It will be seen from FIGS. 1 and 5 that the modular construction of the inventive device with 45° bends, 90° bends, and straight pieces/joints allows the inventive device to be arranged in several different configurations to suit particular applications. In all of these configurations, however, turbulence is minimized by the gradual curvature of the water conduit and the unbroken smooth interior wall of the water conduit. The straight pieces such as 29 in FIG. 1 form a counterpart to a joint such as 22 to maintain the ability of axes 20 and 37 to become coaxial in the FIG. 1 position.

The novel geometry of the inventive monitor presents some control issues not encountered in the prior art. Specifically, for example, in a vertically mounted monitor, a transition of the nozzle 28 from a horizontal to a vertical orientation while remaining in the same vertical plane 50 (FIG. 8) requires a coordinated simultaneous rotation of both the joint 22 and the joint 16. Thus, in FIG. 8, if the home position of the nozzle 28 is coaxial to the intersection of horizontal plane 52 and vertical plane 50, a transition of the nozzle 28 in the vertical plane 50 from horizontal to vertical requires a simultaneous rotation of the joints 22 and 16 in accordance with the trigonometrically derived formulas $$T=\arccos\{(1/\sin^2 M)*(\cos^2 M-\sin E)\} \quad (1)$$

$$B=\arctan\{\sin T/[\cos M*(1+\cos T)]\} \quad (2)$$

wherein E is a desired elevation angle above the horizontal plane 52; M is the inclination of the axis 26 of the joint 22 with respect to the axis 20; T is the required rotation angle of joint 22; and B is the required rotation angle of joint 16.

In order to aim the nozzle 28 at the elevation E in any vertical plane 54 other than the plane 50, the desired azimuth angle A is simply added to the rotation required by formula (2), so the total rotation R of joint 16 is $$R=B+A \quad (3)$$

For the simplest case in which M=45° (and consequently sinM equals cosM), formula (1) reduces to $$T=\arccos\{1-(\sin E/\sin^2 M)\} \quad (4)$$

Figure 8:
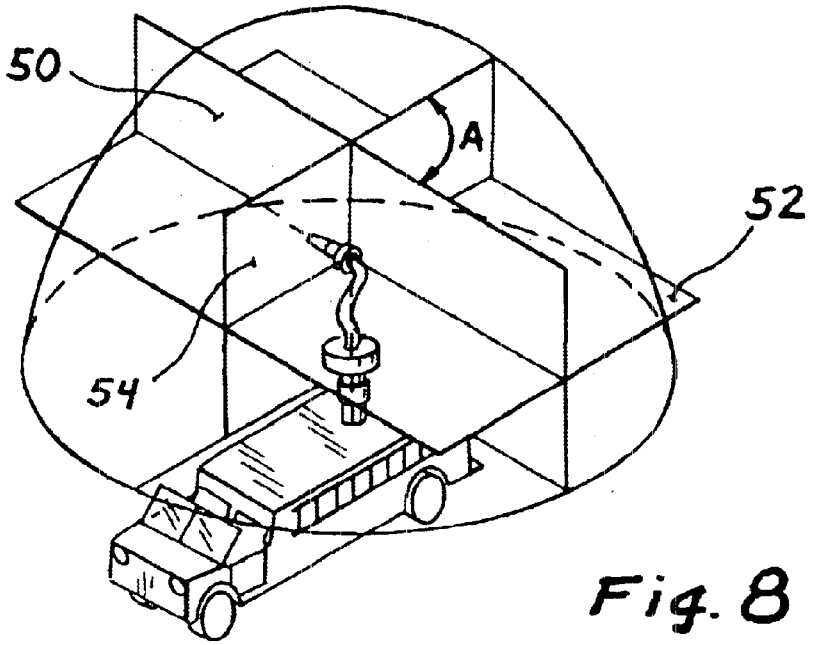
FIG. 8 is a spatial diagram illustrating the geometry of the inventive monitor.

For elevation changes in 5° increments, formula (4) yields the following look-up table for a nozzle transition from horizontal to vertical in plane 50 of FIG. 8:

TABLE I

| Elevation (degrees) | Joint 22 (degrees) | Joint 16 (degrees) |
|---|---|---|
| 0 | 0 | 0 |
| 5 | 34 | 24 |
| 10 | 49 | 33 |
| 15 | 61 | 40 |
| 20 | 72 | 46 |
| 25 | 81 | 50 |
| 30 | 90 | 55 |
| 35 | 98 | 59 |

TABLE I-continued

| Elevation (degrees) | Joint 22 (degrees) | Joint 16 (degrees) |
|---|---|---|
| 40 | 107 | 62 |
| 45 | 114 | 66 |
| 50 | 122 | 69 |
| 55 | 130 | 72 |
| 60 | 137 | 74 |
| 65 | 144 | 77 |
| 70 | 152 | 80 |
| 75 | 159 | 82 |
| 80 | 166 | 85 |
| 85 | 173 | 87 |
| 90 | 180 | 90 |

It will be seen that the rotation of neither joint is linear, with the rotations for each 5° interval being greatest near the horizontal and diminishing toward the vertical.

Figure 7:
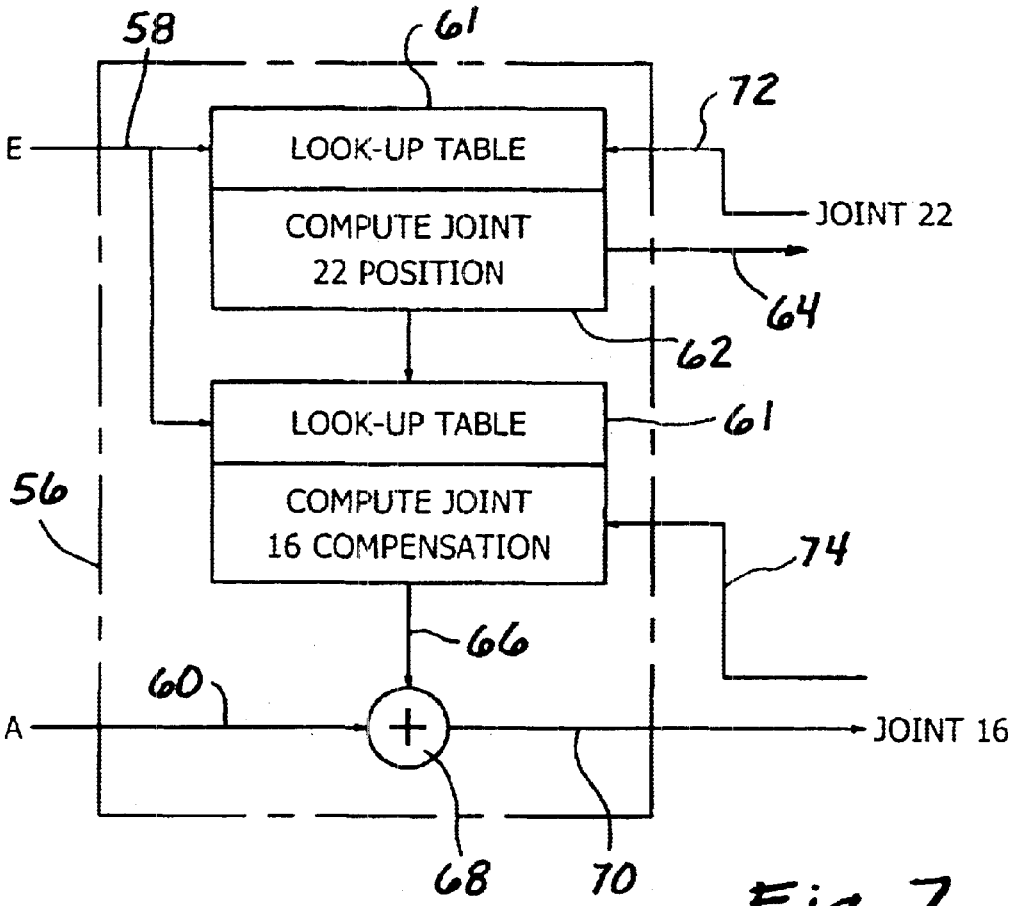
FIG. 7 is a block diagram of an automatic control for the inventive monitor.

The positioning and tracking of the nozzle 28 may readily be accomplished automatically through the use of a microprocessor 56 (FIG. 7). The inputs 58, 60 to the microprocessor 56 are the desired values, respectively, of elevation and azimuth. These may be generated manually, preferably digitally, by a keyboard or joystick. Alternatively, they may be generated by a computer program programmed to move the nozzle 28 in a desired predetermined pattern or in response to an operator's or sensor's instructions.

By means of a look-up table 61 such as Table I above, or by means of direct computation from formulas (1) through (4) above, the microprocessor 56 first computes at 62 a joint-22 position signal 64 that represents the rotational position of joint 22 which will produce the desired elevation, and outputs that signal to the servomotor 36. Based on the input 58 or the signal 64, the microprocessor 56 then computes at 63 the compensatory rotation of joint 16 that is necessary to maintain the nozzle 28 in the vertical home plane 50 at the chosen elevation. The resulting signal 66 is then added in adder 68 to the signal 60 representing the chosen azimuth to produce the joint-16 position signal 70 that is applied to servomotor 34. Position feedback signals 72, 74 from the servomotors 34, 36 may be used to correct any unintended rotation of the joints 22, 16 as a result of torque transients in the water stream or other causes.

The feedback signals 72, 74 may be generated in a variety of ways. For example, a potentiometer or other analog device, an optical encoder, or a Hall effect sensor or other pulse counter, may be used on either a motor or a joint.

The motors 34, 36 may of course be operated manually by a joystick or similar device. Because of the interrelationship of the rotations of joints 22 and 16, however, accurate manual handling of the monitor 10 with a joystick is likely to require skill and experience.

Another way of manually handling the joints 16, 22 in the absence of any motors (or handling motors by incremental-rotation pulsing) relies on a corollary of Table I. If the joint 10 is equipped e.g. with equidistant markings or detent notches around its circumference, the joint 22 can be equipped with corresponding non-equidistant notches or markings that are increasingly farther apart as nozzle 28 approaches the horizontal in FIG. 8. The rotational increments between the markings are so calculated that a rotation of joint 22 from one of its non-equidistant marks to the next requires a compensating movement of joint 16 from one of its equidistant marks to the next. Thus, joint 16 may first be moved to point the nozzle 28 in a desired azimuth direction. Then, if the elevation is changed by moving joint 22 by e.g. three marks, joint 16 need merely also be moved three marks to maintain the nozzle 28 in the same azimuth direction.

It will be understood that the embodiments of the invention described herein are only illustrative, and that the invention may be carried out in a variety of different ways without departing from the scope of the following claims.

I claim:

1. A monitor for discharging fluids from a fixed mount, comprising:

a) a fluid conduit having a base section including a first axis, a midsection, and an exit section;

b) a first joint between said base section and said midsection having a swivelable portion arranged to allow said midsection to swivel about said first axis; and c) a second joint between said midsection, and said exit section having a swivelable portion arranged to allow said exit section to swivel about a second axis positioned at a first acute angle to said first axis;

d) said exit section including a third axis, said third axis being positioned at a second acute angle to said second axis;

e) wherein the swivelable portion of each of said joints is a driveable mechanism, and each of said joints are driveable in such a manner that rotation of one of said joints is accompanied by a compensating rotation of the other of said joints to counter the component of change in position normal to said other of said joints created by rotation of said one of said joints.

2. The monitor of claim 1, in which said acute angles are substantially 45°.

3. The monitor of claim 1, in which said acute angles are substantially equal so that said nozzle and said base section can be brought into coaxiality to discharge fluid coaxially of said base section and nozzle.

4. The monitor of claim 1, in which said driveable mechanism comprises a driven gear, and said monitor further comprises a drive with a substantially smaller drive gear, said drive gear directly drivingly engaging said driven gear.

5. The monitor of claim 4, in which said motor drive is equipped with a brake preventing movement of said drive when said motor is not powered.

6. The monitor of claim 5, in which said brake is manually releasable.

7. A monitor for discharging fluids from a fixed mount, comprising:

a) a fluid conduit having a base section including a first axis, a midsection, and an exit section;

b) a first joint between said base section and said midsection arranged to allow said midsection to swivel about said first axis; and c) a second joint between said midsection and said exit section arranged to allow said exit section to swivel about a second axis positioned at a first acute angle to said first axis;

d) said exit section having a nozzle including a third axis, said third axis being positioned at a second acute angle to said second axis;

wherein the swivelable portion of each of said joints is swiveled by a servomotor.

8. The monitor of claim 7, in which said servomotors are controlled by a microprocessor arranged to swivel one of said joints as a function of the swiveling movement of the other of said joints to maintain said third axis in a plane.

9. A monitor for discharging fluids from a fixed mount, comprising:

a) a fluid conduit having a base section including a first axis, a midsection, and an exit section;

b) a first joint between said base section and said midsection arranged to allow said midsection to swivel about said first axis; and c) a second joint between said midsection and said exit section arranged to allow said exit section to swivel about a second axis positioned at a first acute angle to said first axis;

d) said exit section having a nozzle including a third axis, said third axis being positioned at a second acute angle to said second axis;

wherein when said monitor is vertically mounted, said third axis is maintained in a vertical plane during movement from a horizontal to a vertical position by swiveling said joints in accordance with the formulae $$T=\arccos\{(1/\sin^2 M)*(\cos^2 M-\sin E)\}$$

$$B=\arctan\{\sin T/[\cos M*(1+\cos T)]\}$$

wherein E is the elevation angle of said third axis above the horizontal; M is the inclination of said second axis with respect to said first axis; T is the rotation angle of said second joint required to obtain the elevation angle E; and B is the rotation angle of said first joint required to maintain said third axis in a vertical plane.

10. A monitor for discharging fluids from a fixed mount, comprising:

a) a fluid conduit having a base section including a first axis, a midsection, and an exit section;

b) a first joint between said base section and said midsection arranged to allow said midsection to swivel about said first axis; and c) a second joint between said midsection and said exit section arranged to allow said exit section to swivel about a second axis positioned at a first acute angle to, said first axis;

d) said exit section having a nozzle including a third axis, said third axis being positioned at a second acute angle to said second axis; and e) an automatic control including a programmed computing means, said computing means being programmed to compute the amount of swiveling rotation of said second joint to obtain a desired elevation angle of said third axis, and the compensatory amount of swiveling rotation of said first joint to maintain said third axis in a constant plane.

11. The monitor of claim 10, further comprising:

f) an elevation angle input and an azimuth angle input;

g) said computing means generating a first output signal arranged to so swivel said second joint as to produce said elevation angle in said third axis in accordance with the formula $$T=\arccos\{(1/\sin^2 M)*(\cos^2 M-\sin E)\}$$

wherein E is the elevation angle of said third axis above the horizontal; M is the inclination of said second axis with respect to said first axis; and T is the rotation angle of said second joint required to obtain the elevation angle E; and h) said computing means further generating a second output signal arranged to so swivel said first joint as to produce said azimuth angle in said third axis in accordance with the formula $$R=A+\arctan\{\sin T/[\cos M*(1+\cos T)]\}$$

wherein E is the elevation angle of said third axis above the horizontal; M is the inclination of said second axis with respect to said first axis; T is the rotation angle of said second joint required to obtain the elevation angle E; A is the desired azimuth angle; and R is the swiveling rotation of said first joint required to position said third axis at the desired azimuth and elevation angles.

12. The monitor of claim 10, in which said computing means compute said formulae by digitally accessing a look-up table.

13. A monitor for discharging fluids from a fixed mount, comprising:

a) a fluid conduit having a base section including a first axis, a midsection, and an exit section;

b) a first joint between said base section and said midsection arranged to allow said midsection to swivel about said first axis; and c) a second joint between said midsection and said exit section arranged to allow said exit section to swivel about a second axis positioned at a first acute angle to said first axis;

d) said exit section having a nozzle including a third axis, said third axis being positioned at a second acute angle to said second axis;

wherein when said nozzle is aimed straight ahead, such that said first and third axes are aligned, water flow through said fluid conduit from the base section through the exit section travels serially in a plurality of substantially different directions, yet creates no net torque on said monitor.

14. The monitor of claim 1, wherein each set of drive gears and driven gears comprise a direct drive system rather than a worm gear drive system.

15. The monitor of claim 4, wherein said drive further comprises a motor.

* * * * *

US006655613C1

(12) EX PARTE REEXAMINATION CERTIFICATE (8682nd)

United States Patent
Brown

(10) Number: US 6,655,613 C1
(45) Certificate Issued: Nov. 22, 2011

(54) FIRE-FIGHTING WATER TURRET

(75) Inventor: Arthur E. Brown, Mission Viejo, CA (US)

(73) Assignee: Linda L. Brown, Ledera Ranch, CA (US)

Reexamination Request:
No. 90/011,470, Mar. 16, 2011

Reexamination Certificate for:

| | |
|---|---|
| Patent No.: | **6,655,613** |
| Issued: | **Dec. 2, 2003** |
| Appl. No.: | **09/882,003** |
| Filed: | **Jun. 15, 2001** |

Related U.S. Application Data

(60) Provisional application No. 60/213,016, filed on Jun. 21, 2000.

(51) Int. Cl.
*B05B 15/08* (2006.01)

(52) U.S. Cl. ..... 239/587.1; 169/24

(58) Field of Classification Search ..... 239/587
See application file for complete search history.

(56) References Cited

To view the complete listing of prior art documents cited during the proceeding for Reexamination Control Number 90/011,470, please refer to the USPTO's public Patent Application Information Retrieval (PAIR) system under the Display References tab.

*Primary Examiner*—Joseph A. Kaufman

(57) ABSTRACT

A fire-fighting turret or monitor includes a curved pipe formed in three successive sections separated by swivelable joints. The first joint swivels about the axis of the first section; the second joint swivels about an axis disposed at an acute angle to the first axis; and the third section includes a corresponding bend so that the exit from the third section can be pointed anywhere within substantially a hemisphere.

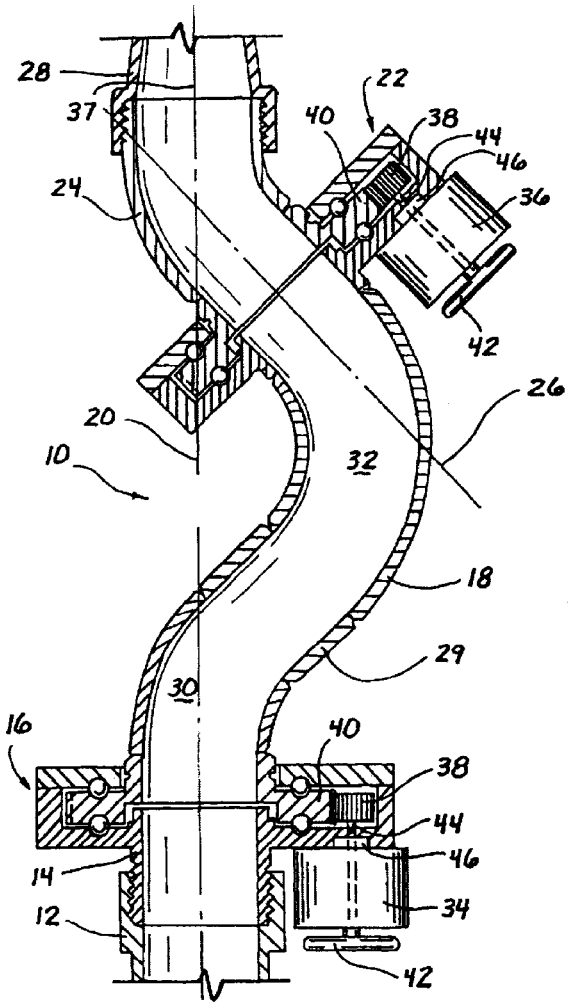

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 9-12 is confirmed.

Claims 1, 7, 8 and 13 are determined to be patentable as amended.

Claims 2-6, 14 and 15, dependent on an amended claim, are determined to be patentable.

New claims 16 and 17 are added and determined to be patentable.

1. A monitor for discharging fluids from a fixed mount, comprising:

a) a fluid conduit having a base section including a first axis, a midsection, and an exit seciton;

b) a first joint between said base section and said midsection having a swivelable portion arranged to allow said midsection to swivel about said first axis; and c) a second joint between said midsection, and said exit section having a swivelable portion arranged to allow said exit section to swivel about a second axis positioned at a first acute angle to said first axis;

d) said exit section including a third axis, said third axis being positioned at a second acute angle to said second axis;

e) wherein the swivelable portion of each of said joints is a driveable mechanism, and each of said joints are driveable in such a manner that rotation of one of said joints is accompanied by a compensating rotation of the other of said joints to counter the component of change in position normal to said other of said joints created by rotation of said one of said joints[.], *so that the direction in which the monitor can discharge fluids from the fixed mount can be varied over a range of substantially 90° in a plane in which the first axis lies, by driving the first joint and the second joint in a concurrent non-linear manner*.

7. A monitor for discharging fluids from a fixed mount, comprising:

a) a fluid conduit having a base section including a first axis, a midsection, and an exit section;

b) a first joint between said base section and said midsection arranged to allow said midsection to swivel about said first axis, *the first joint comprising a first swivelable portion*; and c) a second joint between said midsection and said exit section arranged to allow said exit section to swivel about a second axis positioned at a first acute angle to said first axis, *the second joint comprising a second swivelable portion*;

d) said exit section having a nozzle including a third axis, said third axis being positioned at a second acute angle to said second axis;

wherein the *first* swivelable portion [of each of said joints] *and the second swivelable portion* is swiveled by *at least one* servomotor *in a concurrent non-linear manner*.

8. The monitor of claim 7, in which said [servomotors are] servomotor *at least one is* controlled by a microprocessor arranged to swivel one of said joints as a function of the swiveling movement of the other of said joints to maintain said third axis in a plane *of the first axis*.

13. A monitor for discharging fluids from a fixed mount, comprising:

a) a fluid conduit having a base section including a frist axis, a midsection, and an exit section;

b) a first joint between said base section and said midsection arranged to allow said midsection to swivel about said first axis; and c) a second joint between said midsection and said exit section arranged to allow said exit section to swivel about a second axis positioned at a first acute angle to said first axis;

d) said exit section having a nozzleincluding a third axis, said third axis being positioned at a second acute angle to said second axis;

*wherein the geometry of the midsection is fixed and the geometry of the exit section is fixed; and* wherein when said nozzle is aimed straight ahead, such that said first and third axes are aligned, water flow through said fluid condiut from the base section through the exit section travels serially in a plurality of substantially different directions, yet creates no net torque on said monitor.

*16. A monitor for discharging liquids from a fixed mount, the monitor comprising:*

*an enclosed liquid conduit comprising a base section, a midsection, and an exit section, wherein:*

*the base section comprises a straight tubular base portion defining a first axis along center of the straight tubular base section,*

*the midsection comprises a straight tubular middle portion and a curved middle portion,*

*the exit section comprises a curved exit portion and a straight tubular exit portion defining a third axis along center of the straight tubular exit portion;*

*a first joint coupling the base section to the midsection to allow swiveling of the midsection relative to the base section about the first axis;*

*a second joint coupling the midsection to the exit section to allow swiveling of the exit section relative to the midsection about a second axis; and*

*means for swiveling the first joint and the second joint in a coordinated simultaneous manner to change direction of the third axis in a selected constant plane in which the first axis lies;*

*wherein*

*the second axis is positioned at a first acute angle to the first axis and the third axis is positioned at a second acute angle to the second axis,*

*the monitor is configured to receive a liquid from the fixed mount at the base section, and discharge the liquid through the exit section in a selectable direction within substantially a hemisphere, and*

*the monitor can be configured by swiveling the first and second joints so that the first axis is coaxial with the third axis.*

*17. The monitor of claim 16, wherein the geometry of the midsection is fixed and the geometry of the exit section is fixed.*

* * * * *